US008151507B2

(12) United States Patent
Johnson

(10) Patent No.: US 8,151,507 B2
(45) Date of Patent: Apr. 10, 2012

(54) FIREARM SUPPORT APPARATUS

(76) Inventor: Christopher David Johnson, Crawfordsville, IN (US)

( * ) Notice: Subject to any disclaimer, the term of this patent is extended or adjusted under 35 U.S.C. 154(b) by 166 days.

(21) Appl. No.: 12/727,085

(22) Filed: Mar. 18, 2010

(65) Prior Publication Data

US 2010/0236126 A1 Sep. 23, 2010

Related U.S. Application Data

(60) Provisional application No. 61/161,370, filed on Mar. 18, 2009.

(51) Int. Cl.
*F41C 27/00* (2006.01)
*F16M 11/38* (2006.01)

(52) U.S. Cl. ..... 42/94; 248/166

(58) Field of Classification Search ..... 42/94; 89/37.04, 89/37.09, 37.13, 41.01, 41.18; 248/150, 248/166, 528, 519
See application file for complete search history.

(56) References Cited

U.S. PATENT DOCUMENTS 2,973,929 A * 3/1961 Zawadzki ..... 248/513
5,613,658 A * 3/1997 Rogelja ..... 248/163.1

* cited by examiner

*Primary Examiner* — Bret Hayes
(74) *Attorney, Agent, or Firm* — Ice Miller LLP

(57) ABSTRACT

A firearm support apparatus operable to increase the accuracy of a weapon, comprising first and second vertical frame element 20 movably attached to swivel attachment 40 at one end, and movably attached to first and second horizontal frame element 25 by at least one tension spring 30. At the end opposite the at least one tension spring 30, first and second horizontal frame element 25 are optionally held together by a horizontal tension spring 35. It will be appreciated that the first and second vertical frame element 20 and first and second horizontal frame element 25 may be arranged such that they form two nearly triangular supports, allowing for a firearm to be suspended from the apex of one such triangle, and wherein the at least one tension springs are sized and selected to reduce the weight of the firearm suspended therefrom, allowing full range of movement by a shooter.

14 Claims, 4 Drawing Sheets

FIREARM SUPPORT APPARATUS

PRIORITY

This application claims priority to U.S. Provisional Patent Application Ser. No. 61/161,370, filed Mar. 18, 2009 titled "Improved Sniper Rifle", the contents of which are incorporated by reference herein.

BACKGROUND

Target shooters, snipers, hunters, and other users of rifles and other firearms often utilize a rest or other means of creating mechanical advantage over the movement of the end of a weapon, particularly when accuracy is important. For instance, a bench rest is typically used by target shooters, with a rest positioned under the gun at a point typically distal to the balance point of the firearm, thereby allowing a shooter to more easily reduce the movement of the end of the barrel, which can greatly improve control over shot placement and accuracy. Further, many gun rests utilize a bipod or tripod attachment to the fore end of the stock or rifle to act as a rest to steady shots. However, changing the height of the fore end of the gun is tedious as it requires extending each of the supports. Additionally, the angular deflection and depression angles are inherently limited by the height of the bipod or tripod and the length of the firearm. In situations where targets may approach from multiple entry points, or where the angle of target entry may change rapidly, these inherent limitations in a bipod or tripod design require that the bipod or tripod base be removed from its support surface or that the length of the legs be changed. These substantial changes in the support mechanism or in where the support is located necessarily take time, and often requires the shooter to loose sight of the target. Such actions may cause the shooter to miss an opportunity at a shot, which could be the loss of a once in a lifetime game trophy, or, in the event of a sniper or other military operation, an enemy combatant that now has moved into position to place the shooter in harms way. As such, a means for stabilizing a firearm that allows free movement, including easier height adjustment and stabilizing from a point nearer to the center of gravity or center of weight of the firearm would be greatly appreciated.

DETAILED DESCRIPTION

Figure 1:
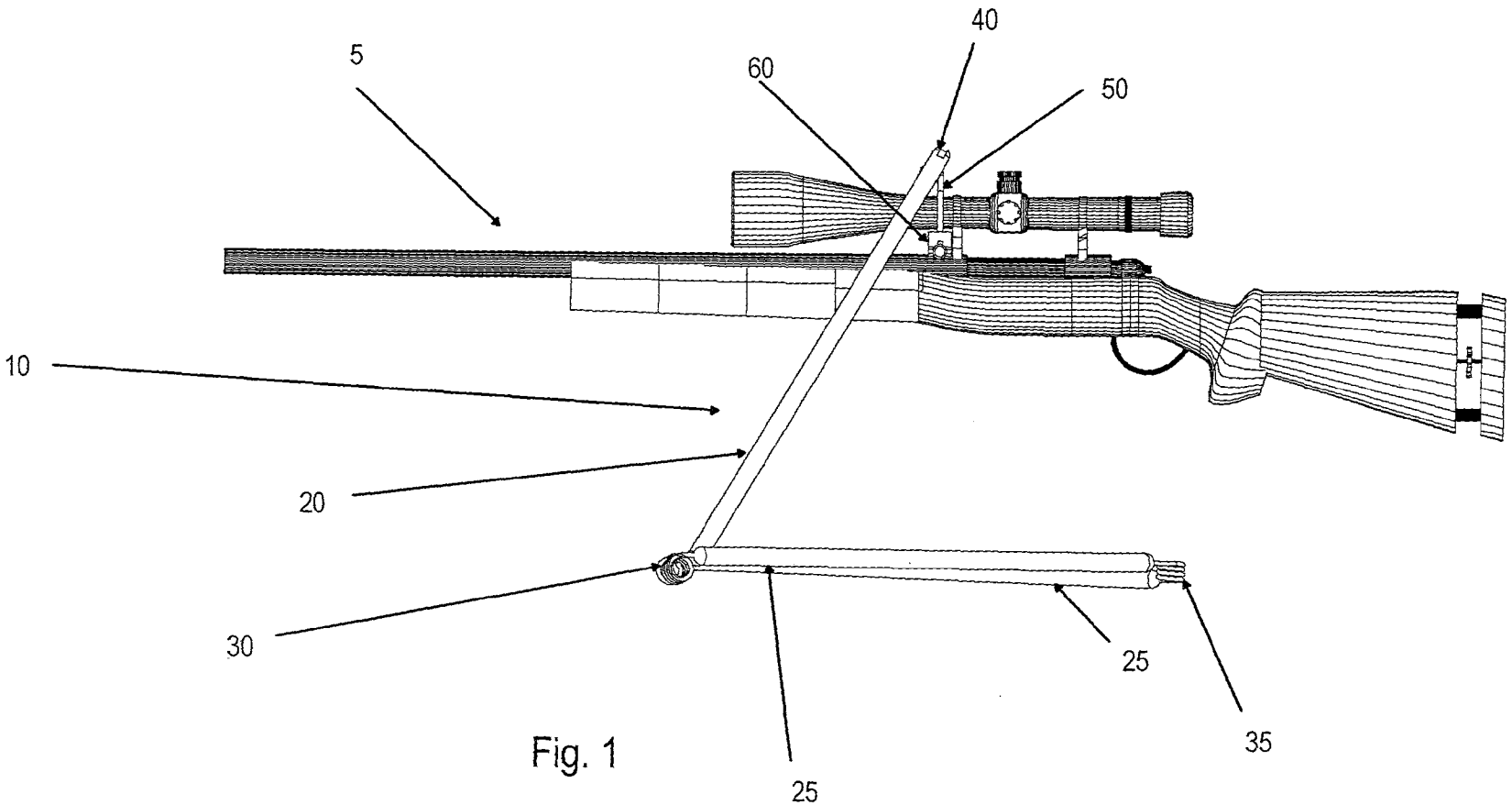
FIG. 1 is a side plan view of a firearm support apparatus holding a rifle according to at least one embodiment.

Turning now to FIGS. 1-4, according to at least one embodiment, a firearm support apparatus 10 comprises first and second vertical frame element 20 movably attached to swivel attachment 40 at one end, and movably attached to first and second horizontal frame element 25 by at least one tension spring 30. At the end opposite the at least one tension spring 30, first and second horizontal frame element 25 are optionally held together by a horizontal tension spring 35. It will be appreciated that the at least one tension spring 30 and/or at least one horizontal tension spring 35 may comprise spring steel, other metals, a rubber, elastic polymer, or other material formulated and oriented that generally causes the two connected members, such as one of the vertical frame elements and one of the horizontal frame elements to be urged away from one another. Further, it will be appreciated that the at least one tension spring 30 and/or at least one horizontal tension spring 35 may comprise a hinge or other rotatable joint operable to allow rotation about the connection, although such a configuration will eliminate certain advantages discussed in further detail below.

According to at least one embodiment, in operation, the at least one tension spring 30 is selected and oriented to resist the gravitational pull from firearm 5 such that the upward and forward urging of first and second vertical frame elements 20 is approximately the same as, or slightly less than, the downward and backward pull placed upon the first and second vertical frame elements 20 caused by the weight of firearm 5, thereby greatly reducing or eliminating the weight of firearm 5 felt by a shooter. Optionally, tension spring 30 or horizontal tension spring 35 may comprise a spring having selectable tension such that tension can be increased or decreased depending upon the weight of firearm 5, a shooter's preference, or if the lever arm created by vertical frame elements 25 is increased due to telescoping of the vertical frame elements as discussed in further detail below. Therefore, a shooter using firearm support apparatus 10 may readily move the apex of firearm support apparatus 10, which coincides with swivel attachment 40 upward and downward in an arc between swivel attachment 40 and horizontal tension spring 35 with little effort.

Figure 2:
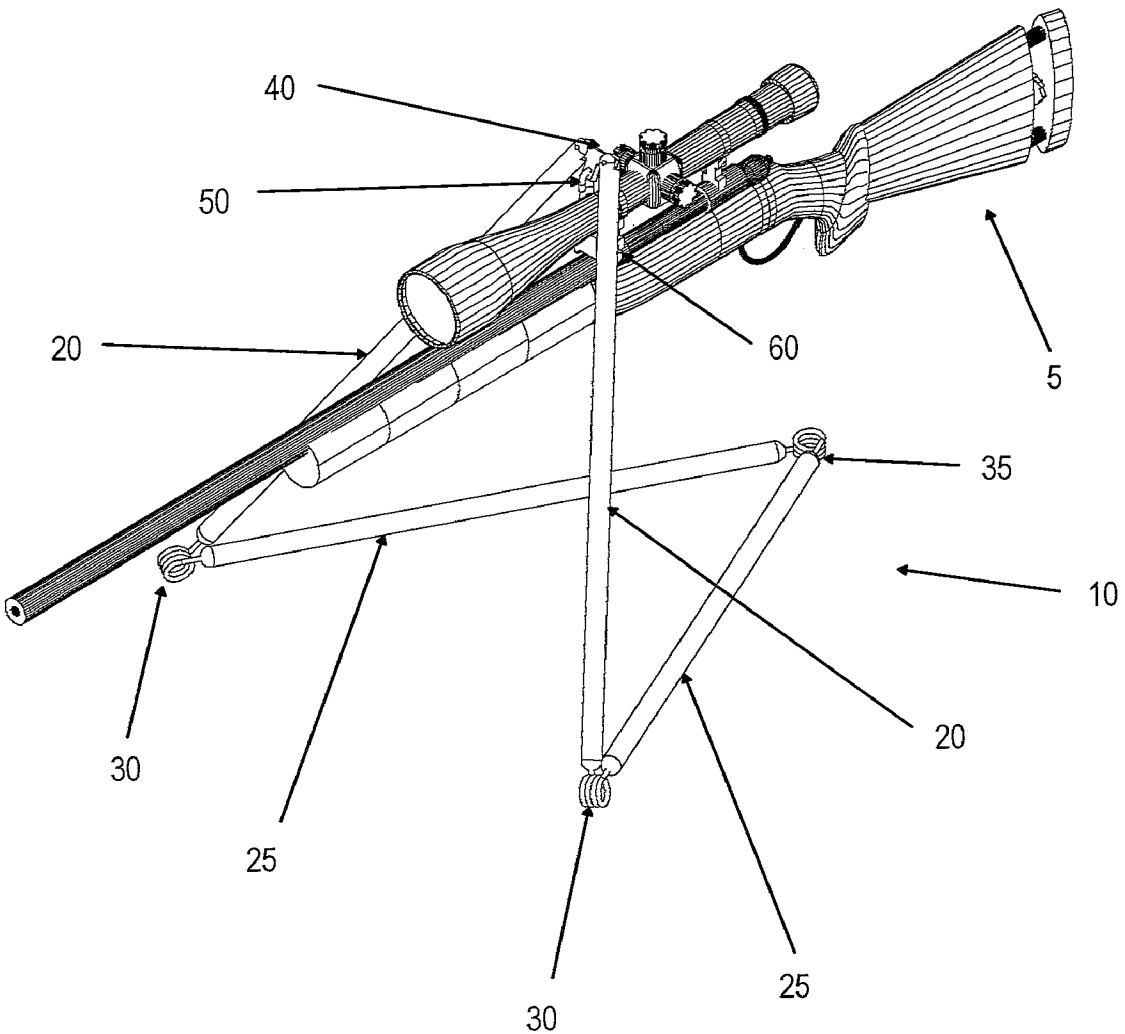
FIG. 2 is a top left perspective view of a firearm support apparatus holding a rifle according to at least one embodiment.
Figure 3:
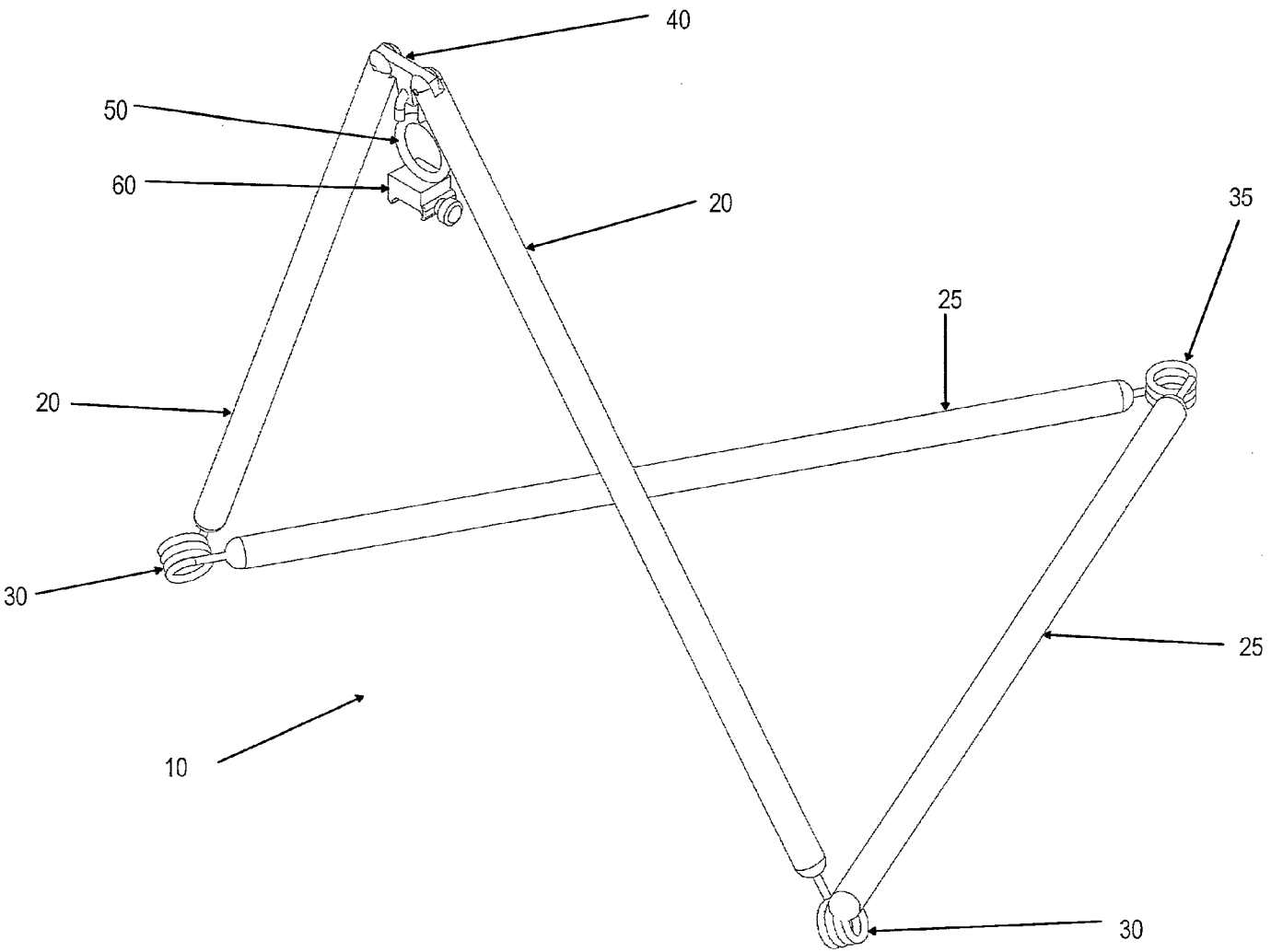
FIG. 3 is a top left perspective view of a firearm support apparatus according to at least one embodiment.

In addition, according to at least one embodiment, a firearm 5 may be removably attached to firearm support apparatus 10 utilizing a firearm attachment mechanism 60, a linkage 50, and, optionally, a shock absorbing member 55. According to at least one embodiment, a firearm attachment mechanism may include a block and/or one or more screws or other attachment devices oriented and operable to mount onto the rail of a firearm (such as an attachment rail found on many military weapons), onto a scope mount as shown in FIGS. 1 and 2, or by other means that allows attachment to a preselected point on a selected firearm 5. Attachment mechanism 60 may be as simple as a loop in a piece of webbing operable to cradle firearm 5, or may be as complicated as a quick detach grip for attaching to a rail or mount point on a selected firearm. It will be appreciated that a number of different attachment points may be selected from according to the needs and preferences of a given shooter, but that, in general, a point along the top of a firearm 5 that approximately represents the balance point of the firearm 5 fore and aft is preferred such that the firearm 5 hangs horizontally as shown in FIG. 1 when untouched.

Additionally, attachment mechanism 60 attaches to firearm 5 at one end while, a linkage 50, attaches to the other end of attachment mechanism 60. Linkage 50 either directly attaches to swivel member 40 of firearm support apparatus 10, or attaches to a shock absorbing member 55. Linkage 50 may optionally comprise a ring or chain, fabric or other webbing, rope, monofilament, or other material operable to connect attachment mechanism 60 to firearm support apparatus 10. In operation, linkage 50 is generally oriented to allow firearm 5 to be rotated on a horizontal and/or vertical plane such that a shooter can manipulate firearm 5 and select an aim point along a broad arc of angles in both the horizontal, vertical, and combined planes.

Figure 4:
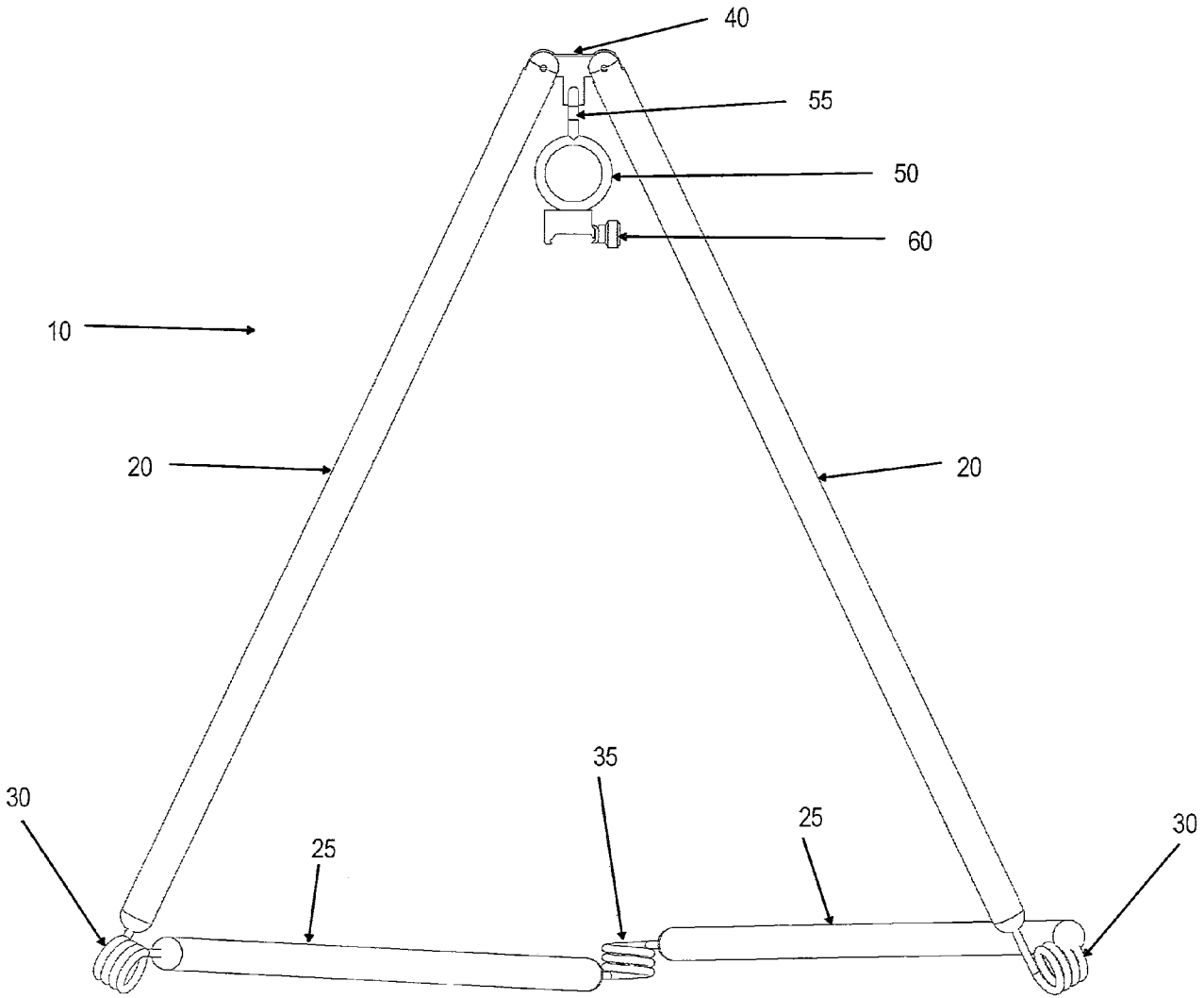
FIG. 4 is a front side plan view of a firearm support apparatus according to at least one embodiment.

Optionally, firearm support apparatus 10 comprises a shock absorbing member 55 as shown in FIG. 4. Shock absorbing member 55 may comprise, for example, an elastic polymer, rubber, a spring, or other flexible material, operable to absorb shock from movement of the rifle, or from movement of a platform or other object upon which firearm support apparatus 10 is placed. For example a shooter may utilize a moving vehicle such as a helicopter or troop transport as the platform upon which the firearm support apparatus 10 is placed, and the at least one horizontal tension spring 35, in cooperation with shock absorbing member 55 aids in keeping firearm 5 in a substantially stationary position even if the second horizontal frame element 25 are being moved due to the movement of the platform upon which it is placed.

According to at least one exemplary embodiment, second horizontal frame element 25 may include a clip or other fastening means operable to secure firearm support apparatus 10 to a platform such as a moving vehicle, helicopter, or other surface. In addition, firearm support apparatus 10 may include straps operable to secure horizontal frame element 25 to vertical frame element 20 in a completely collapsed position. For example, straps may keep horizontal frame element 25 parallel to vertical frame element 20, overcoming the resistance of the one or more vertical tension springs 30. Further, a strap may be utilized to cause the first and second horizontal frame element 25 in a generally parallel position such that the entire firearm support apparatus 10 may be stored in a space no larger than a bundle of four frame elements held in parallel next to one another. Securing straps may be employed to keep the first frame member and the second frame member in the substantially parallel position when not in use, thereby counteracting the assisting force of the resistive device. Optionally, the securing straps may be sized and positioned to provide cushioning for the firearm.

Finally, it will be appreciated that horizontal frame elements 25 and/or vertical frame elements 20 may be telescoping in nature to provide for uneven support or for increasing the potential height of the apex or width of the resulting base.

While specific embodiments have been disclosed herein, combinations of those embodiments, as well as certain variations thereof are included in the scope of this application.

What is claimed is:

1. A firearm support apparatus comprising:

a. a first vertical frame element having a first end and a second end, the second end of the first vertical frame element attached to a first tension spring element;

b. a second vertical frame element having a first end and a second end, the first end of the second vertical frame element movably attached to the first end of the first vertical frame element and the second end of the second vertical frame element attached to a second tension spring element;

c. a first horizontal frame element having a first end and a second end, the second end of the first horizontal frame element attached to the first tension spring element;

d. a second horizontal frame element having a first end and a second end, the first end of the second horizontal frame element movably attached to the first end of the first horizontal frame element, and the second end of the second horizontal frame element attached to the second tension spring element; and e. a firearm attachment mechanism attached to a selected portion of the firearm support apparatus via a linkage.

2. The firearm support apparatus of claim 1, wherein the first tension spring element and the second tension spring elements are operable to adjust spring tension.

3. The firearm support apparatus of claim 1, wherein the first tension spring element comprises a metal spring operable to create a tension urging the second end of the first horizontal frame element away from the second end of the first vertical frame.

4. The firearm support apparatus of claim 3, wherein the second tension spring element comprises a metal spring operable to create a tension urging the second end of the second horizontal frame element away from the second end of the second vertical frame element.

5. The firearm support apparatus of claim 1, wherein the first tension spring element comprises an elastomeric composition operable to create a tension urging the second end of the first horizontal frame element away from the second end of the first vertical frame element.

6. The firearm support apparatus of claim 5, wherein the second tension spring element comprises an elastomeric composition operable to create a tension urging the second end of the second horizontal frame element away from the second end of the second vertical frame element.

7. The firearm support apparatus of claim 1, wherein the first vertical frame element and the second vertical frame element are telescoping tubes.

8. The firearm support apparatus of claim 1, wherein the first vertical frame element and the second vertical frame element meet at a vertex formed by a moveable attachment between the first ends of the first and second vertical elements.

9. The firearm support apparatus of claim 8, wherein the first vertical frame element and the second vertical frame element define a movable angle at the vertex between the first and second vertical frame elements.

10. The firearm support apparatus of claim 9, wherein the first vertical frame element and the second vertical frame element define a first plane and the first horizontal frame element and the second horizontal frame element define a second plane.

11. The firearm support apparatus of claim 10, wherein the first and second tension spring elements lie in a line at the intersection of the first plane and the second plane.

12. The firearm support apparatus of claim 1, wherein a horizontal spring element movably attaches the first end of the first horizontal frame element to the first end of the second horizontal frame element.

13. The firearm support apparatus of claim 1, wherein the second tension spring element comprises a metal spring operable to create a tension urging the second end of the second horizontal frame element away from the second end of the second vertical frame element.

14. The firearm support apparatus of claim 1, wherein the second tension spring element comprises an elastomeric composition operable to create a tension urging the second end of the second horizontal frame element away from the second end of the second vertical frame element.

* * * * *